US010683748B2

(12) United States Patent
Rogacheva et al.

(10) Patent No.: US 10,683,748 B2
(45) Date of Patent: Jun. 16, 2020

(54) COMMUNICATION SYSTEMS AND METHODS

(71) Applicant: Expro North Sea Limited, Dyce, Aberdeenshire (GB)

(72) Inventors: Alexandra Vasil'evna Rogacheva, Southampton (GB); Brian Phillip Champion, Wimborne (GB)

(73) Assignee: Expro Meters, Inc., Wallingford, CT (US)

( * ) Notice: Subject to any disclaimer, the term of this patent is extended or adjusted under 35 U.S.C. 154(b) by 0 days.

(21) Appl. No.: 16/345,127

(22) PCT Filed: Oct. 25, 2017

(86) PCT No.: PCT/GB2017/053212
§ 371 (c)(1),
(2) Date: Apr. 25, 2019

(87) PCT Pub. No.: WO2018/078357
PCT Pub. Date: May 3, 2018

(65) Prior Publication Data

US 2019/0284929 A1 Sep. 19, 2019

(30) Foreign Application Priority Data

Oct. 25, 2016 (GB) ..... 1617955.8

(51) Int. Cl.
*E21B 47/12* (2012.01)

(52) U.S. Cl.
CPC ..... *E21B 47/122* (2013.01)

(58) Field of Classification Search
CPC ..... E21B 47/122; G01V 11/002
See application file for complete search history.

(56) References Cited

U.S. PATENT DOCUMENTS 5,576,703 A * 11/1996 MacLeod ..... E21B 47/122 340/854.4
2007/0024464 A1* 2/2007 Lemenager ..... E21B 47/122 340/853.1

(Continued)

FOREIGN PATENT DOCUMENTS

EP 0314654 A1 5/1989

OTHER PUBLICATIONS

Champion et al. "Reducing Reservoir Uncertainty During Appraisal and Development—Novel Applications of a New Wireless Reservoir Monitoring Technology in Santos Basin Pre-Salt", SPE Annual Technical Conference and Exhibition, Sep. 28, 2015.

(Continued)

*Primary Examiner* — Sisay Yacob
(74) *Attorney, Agent, or Firm* — Getz Balich LLC

(57) ABSTRACT

In described examples, there are systems and methods for deployment in proximity to an abandoned well. The systems and methods may help monitor conditions at an abandoned well and/or help communication with downhole communicate devices. In some examples, there is described a communication system that is configured to be deployed in proximity to an abandoned well having a metallic well structure severed below a ground region. The system may include a plurality of receivers configured to be deployed at the ground region in proximity to the abandoned well, and configured to receive data signals from the metallic well structure of the abandoned well via the ground region. The system may comprise a processing unit, in communication with the receivers, and configured to receive and process data signals from the receivers.

20 Claims, 5 Drawing Sheets

(56) References Cited

U.S. PATENT DOCUMENTS

| | | | | |
|---|---|---|---|---|
| 2008/0060846 | A1* | 3/2008 | Belcher | E21B 47/06 175/25 |
| 2011/0205847 | A1 | 8/2011 | Lemenager | |
| 2013/0180726 | A1* | 7/2013 | Ross | E21B 47/122 166/336 |
| 2013/0299165 | A1* | 11/2013 | Crow | E21B 33/12 166/250.08 |

OTHER PUBLICATIONS

Exprogroup, "Wireless Well Solutions CaTS Cableless Telemetry System", Aug. 17, 2016.

* cited by examiner

COMMUNICATION SYSTEMS AND METHODS

This application claims priority to PCT Patent Appln. No. PCT/GB2017/053212 filed Oct. 25, 2017, which claims priority GB Patent Appln. No. 1617955.8 filed Oct. 25, 2016, which are herein incorporated by reference.

BACKGROUND OF THE INVENTION

1. Technical Field

Described examples relate to systems, methods and other apparatus for use with wells, such as an oil and gas well, and in particular abandoned wells. Some examples relate specifically to systems, methods and other apparatus for use at offshore wells.

2. Background Information

At the end of the lifecycle of a typical oil and gas well, a process of permanent abandonment will occur. Each territory in which the well and associated infrastructure is located will typically have its own abandonment requirements that may require different procedures to be adhered to during and/or following the abandonment process. Further, the process of abandoning a well may differ somewhat depending on whether the well is onshore or offshore.

That said, it is not uncommon for there to be similar or overlapping procedures adopted in each of the above circumstances, which include isolating any freshwater zones associated with the well; isolating from the well any future production zones; preventing leaks to/from the well; and, in addition to removing wellheads, etc., also cutting and removing all well structure such as casing strings, etc., to a particular level below the surface.

It will be appreciated that the surface or otherwise ground region associated with an onshore well may relate to the surface from which the well structure extends into ground and then down to the formation, whereas for an offshore well, the surface or ground region may relate to the mudline, or the like, again from which well structure extends down to the formation below.

This background serves only to set a scene to allow a skilled reader to better appreciate the following description. Therefore, none of the above discussion should necessarily be taken as an acknowledgement that that discussion is part of the state of the art or is common general knowledge. One or more aspects/embodiments of the invention may or may not address one or more of the background issues.

SUMMARY OF THE INVENTION

In described examples, there are systems and methods for deployment in proximity to an abandoned well. The systems and methods may help monitor conditions at an abandoned well and/or help communicate with downhole communicate devices.

In some examples, there is described a communication system that is configured to be deployed in proximity to an abandoned well having a metallic well structure severed below a ground region.

Such a system may comprise a plurality of receivers configured to be deployed at the ground region in proximity to the abandoned well. Those receivers may be configured to receive data signals from the metallic well structure of the abandoned well via the ground region. The system may also comprise a processing unit, in communication with the receivers, configured to receive data signals from the receivers. In some examples, the processing unit may be configured to process those data signals.

The severed metallic well structure may have been severed as part of the abandonment process. The system may be configured to receive data signals from the metallic well structure of the abandoned well through roughly 1 to 20 meters of ground region (e.g. from 2 to 10 meters of ground region).

The receivers may be configured to receive electromagnetic (EM) data signals from the metallic well structure of the well via the ground region. The receivers may be configured to receive data signals having a frequency of in the region of from 0.05 Hz to 10 Hz, or from 0.1 Hz to 5 Hz, or the like.

The receivers may be configured to receive data signals having been communicated from a subsurface region to the receivers using the metallic well structure. In other similar words, the well structure itself may form some of the signal path for the received data signals having been communicated from a subsurface region associated with the abandoned well. Such signals may have been injected or otherwise communicated to the well structure at the subsurface region for communication using the well structure to the ground region—and then so to the receivers.

The communication system may be configured to be fixed, or otherwise secured, to the ground region when deployed. For example, the communication system may comprise one or more fixing legs, configured to extend into the ground region when deployed.

The communication system may be configured such that, when deployed, each of the plurality of receivers are arranged spatially at the ground region in proximity to the abandoned well. In other similar words, the system may be configured such that the plurality of receivers are configured in an array, or the like, at the ground region in proximity to the abandoned well. The relative spacing between each receiver, or otherwise position of each receiver, may be known. The spacing between each, some or all of the receivers may be regular (e.g. spaced at regular intervals).

The system—and in particular the processing unit—may be configured to process, or otherwise fuse, data signals received using different receivers. The system may be configured to correlate data signals having been received using different receivers. In some examples, the system may be configured to correlate or otherwise process data signals received from multiple receivers in order provide a data signal representative of a signal having initially been communicated to the metallic well structure of the abandoned well (e.g. and subsequently received via the ground region).

The plurality of receivers may be configured to receive data signals using at least two different receiving methods. In some examples, at least one receiver may be configured to receive data signals using a first receiving method while at least one further receiver may be configured to receive data signals using a second receiving method. For example, at least one receiver may be provided as an electrode (e.g. measuring potential difference), or the like, configured to receive data signals, while at least one other receiver may be provided as an antenna, such as a loop antenna, or the like, in order to receive data signals.

When the system is configured to use at least two receiving methods, the processing unit, in communication with the receivers, may be configured to receive and process data signals having been received from two or more receivers using those different receiving methods. In such cases again, the system—and in particular the processing unit—may be configured to process, or otherwise fuse, data signals received using the different receiving methods. The outcome of such processing may provide a processed data signal representative of a signal having initially been communicated to the metallic well structure of the abandoned well, and subsequently received via the ground region.

In some examples, the system may be configured to receive electrical signals via a first receiving method, and to receive magnetic signals via a second receiving method.

The processing unit may be further configured to store processed data for subsequent communication. The processing unit may be configured to communicate processed data from time to time, e.g. regular intervals, or in response to a request for data by another entity.

The system may be configured to be deployed in a body of water. In such examples, the abandoned well may be an abandoned offshore well. The system may be configured to be deployed at a seabed, or mudline, in proximity to an abandoned well. In such examples, the ground region may comprise the associated mudline.

The system may comprise a transmitter configured to communicate processed data for subsequent receipt. For example, the system may be configured to communicate via the body of water (e.g. wirelessly) for subsequent receipt at a remote location. That remote location may include a receiving vessel or the like.

The system may be configured to be deployed at the ground region in proximity to multiple abandoned wells. In some examples, the system may be configured to receive data signals from those multiple metallic well structures of each abandoned well via the ground region.

The system may comprise a plurality of receiver arrays. Each receiver array may have a plurality of receivers configured to be deployed at the ground region in proximity to a particular abandoned well, and be configured to receive data signals from the metallic well structure of that abandoned well via the ground region.

The processing unit of the system may be configured to receive data signals from each array. Otherwise, the system may comprise two or more processing units in communication with receiver arrays.

In some examples, the system, or indeed the plurality of receivers, may be configured to receive data signals having been transmitted from the metallic well structure to the ground region using a repeater unit. That repeater unit may be positioned at the metallic well structure, and may be configured to receive data signals at the well structure, and improve the data signal quality (e.g. amplify) prior to communication to the ground region. As discussed herein, the repeater unit may also be used to receive data signals from transmitters at the ground region and to retransmit the data signals downhole. Those data signals may be directly communicated to the ground region using the repeater unit, or otherwise the repeater unit may be positioned such that signals are communicated back to the metallic structure for subsequent transmission to the ground region.

In some examples, the system may comprise one or more repeater units positioned at the well structure (e.g. proximate a severed well structure). As above, such a repeater unit may be configured to improve data signal quality (e.g. amplify, reduce/cancel noise) prior to communication to the ground region (directly or indirectly). The repeater unit may be configured to modulate data signals being communicated in the metallic structure for transmission via the ground region. For example, the repeater unit may be configured to modulate data signals having been communicated in the metallic well structure for improved communication via the ground region.

In some examples, there is described a method for processing data signals from an abandoned well.

The method may comprise using a plurality of receivers and receiving data signals from a metallic well structure of the abandoned well via a ground region. Those receivers may have been deployed in proximity to the abandoned well.

The method may comprise monitoring conditions at the abandoned well using data from the received data signals. The conditions may comprise temperature and/or pressure conditions at the abandoned well. The data received may permit assessment of integrity of the abandoned well.

The method may comprise receiving data signals from the metallic well structure of the abandoned well through roughly 1 to 20 meters of ground region (e.g. from 2 to 10 meters of ground region). The method may comprise receiving electromagnetic (EM) data signals from the metallic well structure of the well via the ground region. The method may comprise receiving data signals having a frequency of in the region of from 0.05 Hz to 10 Hz, or between 0.1 Hz and 5 Hz, or the like.

The method may comprise receiving data signals having been communicated from a subsurface region to the receivers using the metallic well structure. In other similar words, the well structure itself may form some of the signal path for the received data signals having been communicated from a subsurface region associated with the abandoned well. Such signals may have been injected or otherwise communicated to the well structure at the subsurface region for communication using the well structure to the ground region—and then so to the receivers.

The method may comprise processing, or otherwise fusing, data signals having been received using different receivers. The method may comprise correlating data signals having been received using different receivers. The method may comprise correlating or otherwise processing data signals received from multiple receivers in order provide a data signal representative of a signal having initially been communicated to the metallic well structure of the abandoned well (e.g. and subsequently received via the ground region).

The method may comprise receiving data signals using at least two different receiving methods. The method may comprise receiving and processing data signals having been received from two or more receivers using those different receiving methods. In such cases, the method may comprise processing, or otherwise fusing, data signals received using the different receiving methods.

The method may comprise storing processed data for subsequent communication. The method may comprise communicating processed data from time to time, e.g. at regular intervals. For example, the method may comprise communicating processed data for subsequent receipt (e.g. receipt at a remote location).

The method may comprise receiving data signals from one or more receiver arrays, each array comprising a plurality or receivers.

The method may comprise receiving data signals having been transmitted from the metallic well structure to the ground region using a repeater unit. That repeater unit may be positioned at the metallic well structure, and may be configured to receive data signals at the well structure, and improve the data signal quality (e.g. amplify) prior to communication to the ground region. Those data signals may be directly communicated to the ground region using the repeater unit, or otherwise the repeater unit may be positioned such that signals are communicated back to the metallic structure for subsequent transmission to the ground region.

The method may comprise deploying the plurality of receivers in proximity to an abandoned well. The method may comprise deploying each of the plurality of receivers such that they are arranged spatially at the ground region in proximity to the abandoned well. The relative spacing between each receiver, or otherwise position of each receiver, may be known. The spacing between each some or all of the receivers may be regular (e.g. spaced at regular intervals).

The method may comprise deploying the plurality of receivers in a body of water. In such examples, the abandoned well may be an abandoned offshore well. The method may comprise deploying at a seabed, or mudline, in proximity to an abandoned well. In such examples, the ground region may comprise the associated mudline. The method may comprise deploying at the ground region in proximity to multiple abandoned wells. In some examples, the method may comprise receiving data signals from those multiple metallic well structures of each abandoned well via the ground region.

In some examples, there is described a method for monitoring conditions at an abandoned well.

The method may comprise collecting data associated with an abandoned well.

That collected data may be derived from data signals having been received from a metallic well structure of the abandoned well via a ground region using a plurality of receivers deployed in proximity to the abandoned well.

The method may comprise monitoring conditions of the abandoned well using the collected data.

The collected data may comprise data associated with temperature and/or pressure at regions within the abandoned well. The conditions of the well may include barrier integrity, or the like.

In some examples, there is described a method of abandoning a well.

The method may comprise severing metallic well structure of the well below a ground region. The method may further comprise deploying a plurality of receivers at the ground region in proximity to the abandoned well.

Such receivers may be configured to receive data signals from the metallic well structure of the abandoned well via the ground region.

In some examples, there is described an abandoned well.

The well may have at least one downhole communication device and a surface communication system.

The downhole communication device may be configured to communicate data signals using the well structure of the abandoned well.

The surface communication system may comprise a plurality of receivers deployed at a ground region. Those receivers may be configured to receive data signals from the metallic well structure of the abandoned well via the ground region. The system may further comprise a processing unit, in communication with the receivers, configured to receive and process data signals from the receivers.

In some examples, there is described a computer program product that when programmed into a suitable controller configures the controller to perform any methods disclosed herein. There may be provided a carrier medium, such as a physical or tangible and/or non-transient carrier medium, comprising the computer program product. The carrier medium may be a computer readable carrier medium.

The invention includes one or more corresponding aspects, embodiments or features in isolation or in various combinations whether or not specifically stated (including claimed) in that combination or in isolation. As will be appreciated, features associated with particular recited embodiments relating to systems may be equally appropriate as features of embodiments relating specifically to methods of operation or use, and vice versa.

It will be appreciated that one or more embodiments/aspects may be useful in effective monitoring of a well, in particular abandoned wells, and may help monitor conditions accurately, for example, after the life of any well.

The above summary is intended to be merely exemplary and non-limiting.

BRIEF DESCRIPTION OF THE DRAWINGS

A description is now given, by way of example only, with reference to the accompanying drawings, in which:—

DETAILED DESCRIPTION OF THE INVENTION

For ease of explanation, the following examples have been described in relation to an offshore well and well structure extending below a mudline, and the like. However, it will readily be appreciated that the systems and methods described herein may be equally used and applicable in respect of onshore wells. Similarly, while the following examples may be described in relation to oil and gas wells, and in particular production wells, it will be appreciated that that the same systems and methods, etc., may be used beyond oil and gas applications. A skilled reader will readily be able to implement those various alternative embodiments accordingly.

Figure 1B:
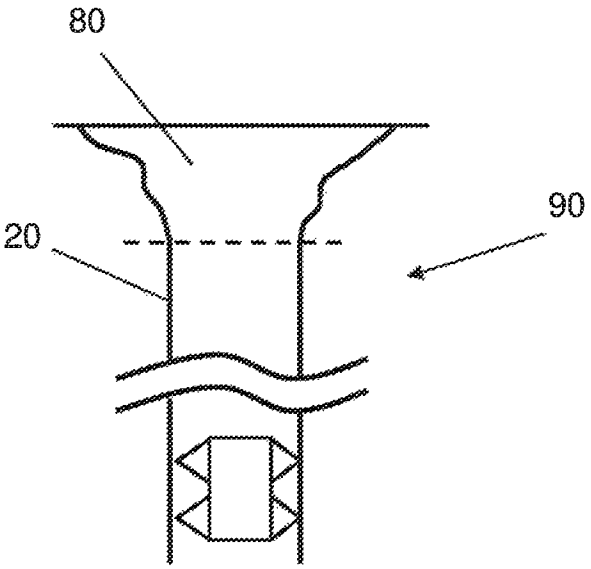
FIG. 1B shows the well severed below a ground region after abandonment.
Figure 1A:
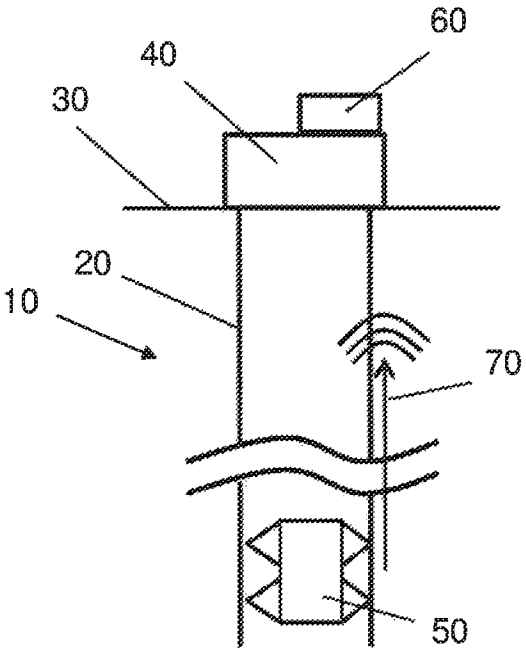
FIG. 1A shows an example of typical well structure.

FIG. 1A shows a simplified representation of a section of a well 10, and in this case an offshore production well 10. Here, well structure 20 extends from the surface—in this case the mudline 30—to a subterranean formation, as will be appreciated. Such well structure 20 can include conductor, casing and other tubing used to recover product from the formation. In this example, the well 10 comprises a wellhead 40, wet tree or the like, at the mudline 30. In other examples, of course, the wellhead/tree arrangement 40 may be provided at a production platform, for example having conductor extending to the seabed, as will be appreciated.

Here, a downhole communication device 50 is configured to communicate signals to the well structure 20 for transmission to a receiver 60, using the well structure 20 as a signal path. In this example, the receiver 60 is positioned at the mudline 30, and is in signal communication with the well structure 20. Here, the downhole communication device 50 is arranged within the bore of the well structure 20 and may be configured to measure, or otherwise obtain from sensors, well conditions such as temperature and/or pressure.

In this example, the downhole communication device 50 is specifically configured to communicate electrical signals to well structures, and in particular communicate signals to the metallic structure of the well (e.g. tubing). In other words, the metallic well structure 20 itself forms the signal path, rather than a dedicated cabling system or the like. As such, the downhole communication device 50 is both in physical and electrical contact with the metallic well structure 20 so as to be able to communicate signals therefrom.

While here the device 50 is shown as being within the well 20 itself, it will be appreciated that in other examples the device 50 may be formed as part of a downhole tool, barrier or the like (e.g. formed together with a plug). In any event, in use, data signals 70 can be communicated from the device 50 to the receiver 60 at surface 30.

The data signals 70 may relate to well conditions downhole, which can then be determined at surface 30 in order to maintain appropriate operation of the well 20, and/or provide information permitting informed decisions regarding interventions or work overs, etc. Of course, in some examples, data signals 70 may additionally or alternatively be communicated from surface 30 to the downhole communication device 50 in a similar manner, as will be appreciated. In some cases, operation of a downhole tool, or other actuation device, may be effected by communicating signals in this manner to the downhole communication device 50.

The system described in FIG. 1A works effectively during normal operation of the well, such as during production. However, during and subsequent to abandonment, as is shown by an abandoned well 90 in FIG. 1B, some of the metallic well structure 20 is severed at a depth below the surface (shown in dashed lines), and the severed well structure 20 removed together with the wellhead 40, etc. As such, a ground region 80 extends from surface 30 to the served well structure 20 that remains. In doing so, a discontinuity in signal path is now apparent. As will be appreciated there may be a desire to continue to receive data signals from a downhole communication device 50, even after abandonment. There may be circumstances in which such a device 50 is deployed as part of the abandonment process (e.g. when specifically configured to collect data regarding barrier integrity, or the like). In those cases, the discontinuity in signal path may be problematic.

Consider now FIG. 2A in which an abandoned well 90 has metallic well structure 20 severed below the ground region 80. Here, a communication system 100 has been deployed in proximity to the abandoned well 90, as will be further explained.

Here, the system 100 comprises a plurality of receivers 110 configured to be deployed at the ground region 80 in proximity to the abandoned well 90. In the example shown in FIG. 2A, two receivers 110*a*, 110*b* have been provided but, as will be described later, more may be used. Here, each receiver 110*a*, 110*b* is configured to receive data signals 70 from the metallic well structure 20 of the abandoned well 90 via the ground region 80. The system 100 further comprises a processing unit 120, in communication with the receivers 110*a*, 110*b*, and is configured to receive and process data signals 70 from the receivers 110*a*, 110*b*. The processing unit 120 may comprise dedicated hardware or firmware configured to process data accordingly. The processing unit 120 may comprise a processor and memory arranged operatively together in a known manner.

As above, the metallic well structure 20 has been severed as part of the abandonment process. As a result, the system 100 is specifically configured to receive data signals 70 from the metallic well structure 20 of the abandoned well through roughly 1 to 20 meters of ground region 80 (e.g. in this case between 2 to 10 meters of ground region 80). The ground region 90 may comprise seabed, or other such material, that is used to cover the severed well structure 20.

In this example, both receivers 110*a*, 110*b* are configured to receive electromagnetic (EM) data signals 70 from the metallic well structure 20 of the well via the ground region 80. In particular, the receivers 110*a*, 110*b* are configured to receive data signals 70 having a frequency of in the region of between 0.05 Hz and 10 Hz, such as between 0.1 Hz and 5 Hz, or the like.

Here, the communication system 100 is configured to be fixed, or otherwise secured, to the ground region 80 when deployed. In some examples, the communication system 100 may comprise one or more fixing legs, configured to extend to the ground region 80 when deployed. The receivers 110*a*, 110*b* may be provided at the fixing legs. In some examples, the system 100 may comprise one or more earth spikes, or the like, configured to provide a grounded potential. This may help in relation to signal reference purposes for the receivers 110*a*, 110*b* (e.g. particularly when communicating EM data signals 70 from the well structure 20).

In use, the system 100—and in this example the processing unit 120—can be configured to process, or otherwise fuse, data signals 70 received using each of the two different receivers 110*a*, 110*b*. In the example shown, the system 100 may be configured to correlate data signals having been received using different receivers 110*a*, 110*b*. By processing data signals 70 received at multiple receivers 110*a*, 110*b*, a data signal representative of a signal having initially been communicated to the metallic well structure 20 of the abandoned well 90 (e.g. and subsequently received via the ground region 80) can be obtained. In such a way, the signal-to-noise ratio can be improved, compared to using only a single receiver 110*a*, 110*b*, which may be helpful given that some of the signal path now comprises the ground region 80. Further, the ease with which the system 100 can be deployed, yet still being able to obtain a suitable signal is improved, compared to deploying a single receiver, given that at least one receiver 110*a*, 110*b* will hopefully be favorably positioned relative to the (now covered) severed well structure 20.

In this manner, data can be collected from an abandoned well 90 from data signals 70 having been received from the metallic well structure 20 of the abandoned well 90 via a ground region 80, specifically using a plurality of receivers 110*a*, 110*b* deployed in proximity to the abandoned well 90. As such, conditions of the abandoned well 90 can be monitored using the collected data. It will be appreciated that the collected data may comprise data associated with temperature and/or pressure at regions within the abandoned well 90, and in fact the conditions of the well may relate to barrier integrity, or the like, which may be an important consideration for long term monitoring of such wells.

Figure 2A:
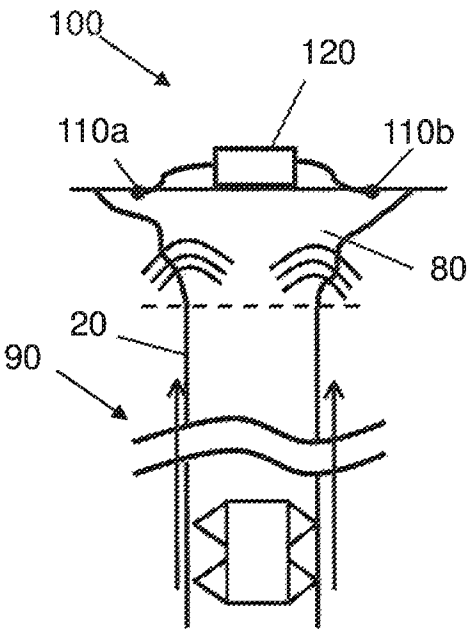
FIGS. 2A, 2B and 2C shows various examples of a communication system having a plurality of receivers.

While in FIG. 2A the system 100 is shown as having two receivers 110*a*, 110*b*, it will be appreciated that in some examples the system 100 may comprise more than two receivers 110*a*, 110*b*. Consider now, by way of an example, FIG. 3A in which the system 100 comprises a plurality of receivers 115*a*-115*f* configured such that, when deployed, each of the plurality of receivers are arranged spatially at the ground region in proximity to the abandoned well. In other similar words, the system 110 may be configured such that the plurality of receivers 115*a*-115*f* are configured in an array, or the like, at the ground region in proximity to the abandoned well 90. The relative spacing between each receiver 115*a*-115*f*, or otherwise the position of each receiver 115*a*-115*f*, may be known or predefined. In the example shown in FIG. 3A, the spacing between each of the receivers 115*a*-115*f* may be considered to be regular (e.g. spaced at regular intervals from one another).

Figure 3A:
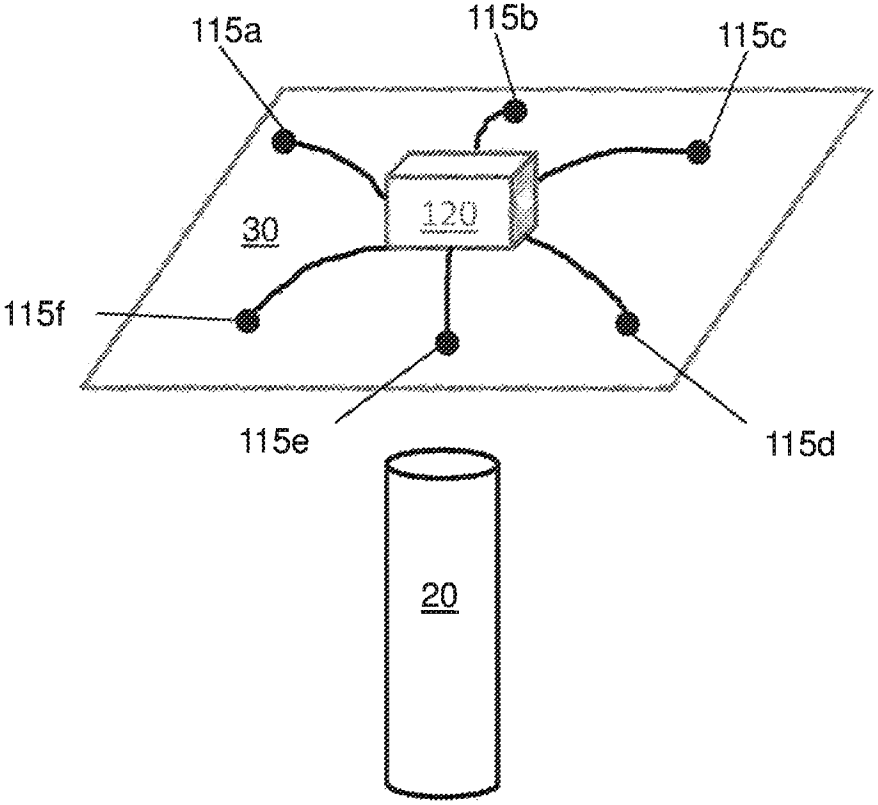
FIGS. 3A and 3B show further examples of the communication system.
Figure 3B:
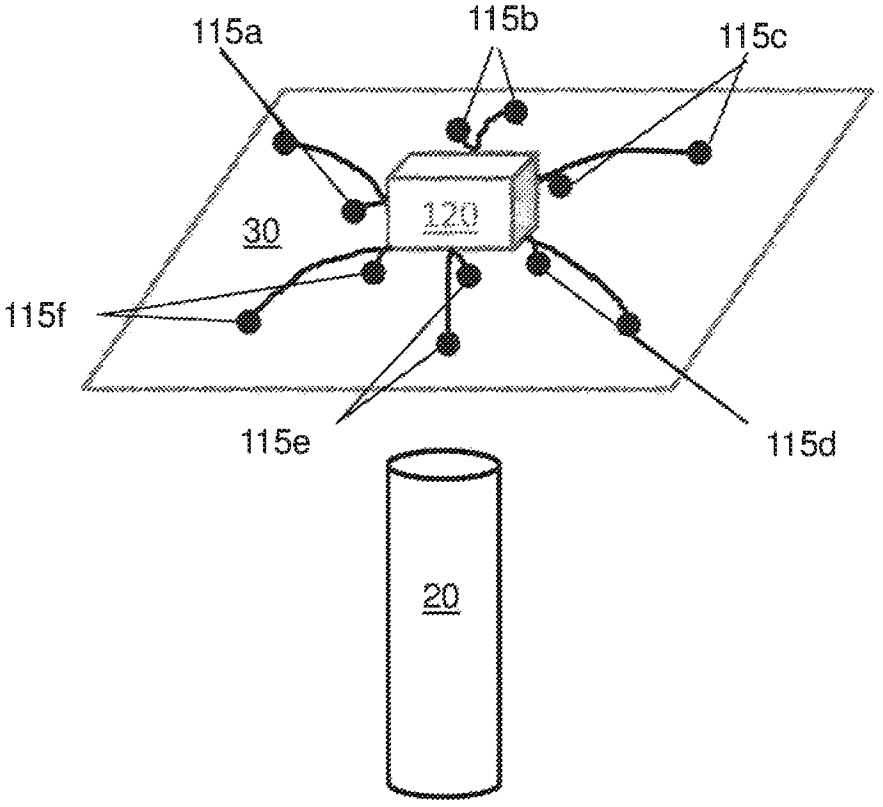

In FIG. 3A, each of the receivers may be configured to measure a potential difference between an electrode formed with the receiver and a common potential at the processing unit 120, or the like. Alternatively, and as is shown in FIG. 3B, each receiver may comprise two electrodes, and be configured to measure the potential difference therebetween.

Figure 2B:
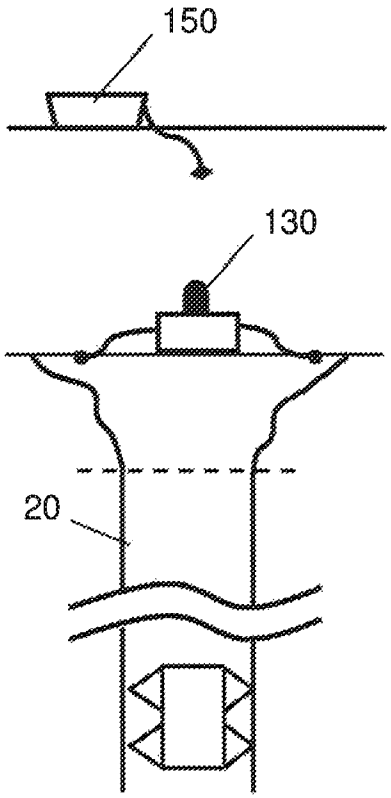

In some examples, as in FIG. 2A, the processing unit 120 may be further configured to store data for subsequent collection/processing. In some cases, as exemplified by FIG. 2B, the system 100 may comprise a transmitter 130 configured to communicate data for subsequent receipt and analysis. In the example shown in FIG. 2B, the system 100 is configured to communicate via a body of water (e.g. wirelessly) for subsequent receipt at a remote location. That remote location may include a receiving vessel 150 or the like.

It will be appreciated at that the processing unit 120 may be configured to communicate processed data when requested to do so, or automatically from time to time, e.g. at regular intervals.

Figure 2C:
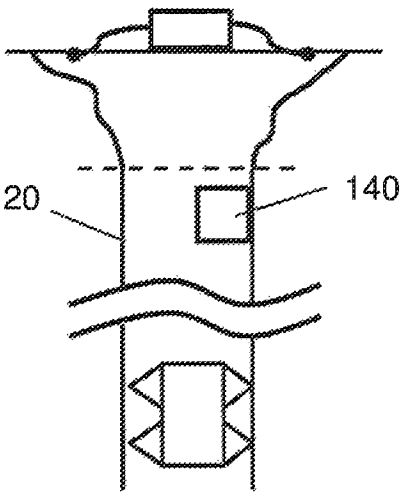

In some examples, as is exemplified in FIG. 2C, the system 100, or indeed the plurality of receivers 110*a*, 110*b*, may be configured to receive data signals 70 having been transmitted from the metallic well structure 20 to the ground region 80 using a repeater unit 140. That repeater unit 140 may be positioned at the metallic well structure 20. In such examples, the repeater unit 140 may be configured to receive data signals at the well structure 20, and improve the data signal quality (e.g. amplify, reduce/cancel noise) prior to communication to the ground region 80. In some examples, those data signals may be directly communicated to the ground region 80 using the repeater unit 140, or otherwise the repeater unit 140 may be positioned such that signals are communicated back to the metallic well structure 20 for subsequent transmission to the ground region 20.

While in some cases, such repeater units 140 may be provided during normal operation of the well, in other cases the repeater unit 140 may be deployed around the time of well abandonment. As such, the repeater unit 140 may be considered to form part of the overall communication system 100.

Either way, the repeater unit 140 may be configured to modify data signals 70 being communicated in the metallic structure for transmission via the ground region 80. For example, the repeater unit 140 may be configured to amplify and/or modulate data signals having been communicated in the metallic well structure 20 for improved communication via the ground region 80. This may be particularly true for repeater units 140 that are deployed around the time of abandonment. In some cases, such repeater units 140 may be configured to convert the frequency of the signal, and/or convert the signal from one signal type (e.g. EM) to another signal type (acoustic) to assist with transmission, as will be appreciated.

While in some examples the receivers 110*a*, 110*b* may be configured similarly, e.g. to receive similar data signals, similar frequencies, etc., in other examples this need not be the case.

Figure 4:
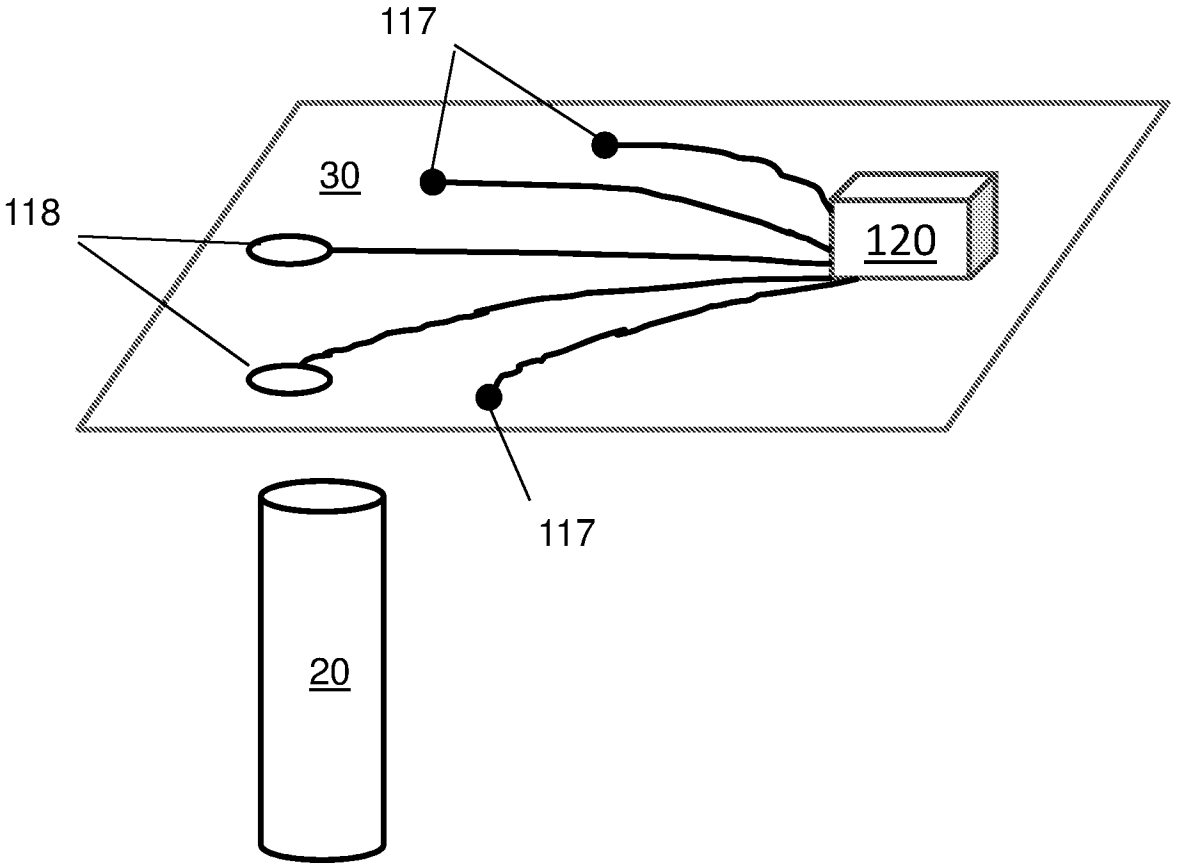
FIG. 4 shows a further example of the communication system.

Consider now FIG. 4, which shows the plurality of receivers 110 configured to receive data signals using at least two different receiving methods. Here, at least one receiver is configured to receive data signals using a first receiving method while at least one further receiver is configured to receive data signals using a second receiving method. In the example shown in FIG. 4, there are essentially two type of receivers provided, a first type 117 provided as an electrode configured to measure a potential difference (e.g. between an electrode and an earth point), and second type 118 configured as a loop antenna, or the like, configured to measure variation in magnetic field.

In FIG. 4, and by way of an example, while the processing unit 120 is offset somewhat from the abandoned well 90, it will be appreciated that the system may still be considered to be deployed in proximity to the well 90.

When the system 100 is configured to use at least two receiving methods, the processing unit 120, in communication with the receivers 117, 118, is configured to receive and process data signals having been received from two or more receivers using those different receiving methods. In such cases again, the system 100—and in particular the processing unit 120—may be configured to process, or otherwise fuse, data signals received using the different receiving methods. By using multiple methods in this manner, the outcome of such processing may provide a processed data signal more representative of a signal having initially been communicated to the metallic well structure 20 of the abandoned well 90, and subsequently received via the ground region 80. In some examples, it may be possible to selectively choose which data/receiver type to use in any subsequent analysis (e.g. based on signal/data quality).

While in the above examples, the system 100 is shown as being deployed in proximity to single abandoned well 90, it will be appreciated that in some examples, the system 100 may be deployed in proximity to multiple abandoned wells, and may be configured to receive data signals therefrom. Further, while in the above examples, the system is configured to receive data signals it will also be appreciated that in other examples, the system may additionally or alternatively be configured to communicate data signals for transmission through a ground region 80 and metallic structure 20, for subsequent receipt at a downhole communication device 50. Further still, while each of the plurality of receivers are shown as discrete, it will be appreciated that they may be deployed together in a combined array.

Further, while it has been described that the processing unit 120 performs some data processing, it will be appreciated that in other examples, the data may be processed at the processing unit in as much as it is received at the processing unit, and then additionally or alternatively stored/communicated in raw format, or close to raw format, for subsequent processing an analysis.

In any event, the collected (and processed data) may be used to monitor conditions at an abandoned well, by collecting data associated with an abandoned well, and looking for changes in that data that may relate to underlying changes in the conditions of the well (e.g. loss of barrier integrity, etc.). The collected data may comprise data associated with temperature and/or pressure at regions within the abandoned well 90.

It should be appreciated that communications systems disclosed herein may be used for transmission of data signals downhole in an abandoned well, in which the metallic well structure has been severed below a ground region. In such arrangements, one or more of the plurality of receivers may be configured as a transceiver and may therefore comprise a transmitter. The transmitter of the at least one transceiver may wirelessly transmit data signals into the ground region, which may be received by the communications device 50 after propagation through the metallic well structure 20 or may be received by the repeater 140, which is configured to inject the data signals into the metallic well structure 20 for propagation therethrough and reception by the communications device 50. The communications device 50 therefore comprises a receiver configured to receive data signals from the metallic well structure 202.

The applicant discloses in isolation each individual feature described herein and any combination of two or more such features, to the extent that such features or combinations are capable of being carried out based on the specification as a whole in the light of the common general knowledge of a person skilled in the art, irrespective of whether such features or combinations of features solve any problems disclosed herein, and without limitation to the scope of the claims. The applicant indicates that aspects of the invention may consist of any such individual feature or combination of features. In view of the foregoing description it will be evident to a person skilled in the art that various modifications may be made within the scope of the invention.

What is claimed is:

1. A communication system for deployment in proximity to an abandoned well having metallic well structure severed below a ground region; the system comprising:

a plurality of receivers configured to be deployed at the ground region in proximity to the abandoned well, and configured to receive data signals from the metallic well structure severed below the ground region of the abandoned well transmitted wirelessly through the ground region; and a processing unit, in communication with the receivers, and configured to receive and process said data signals from the receivers.

2. The system according to claim 1, wherein the system is configured to receive data signals from the metallic well structure of the abandoned well severed below the ground region, the data signals transmitted wirelessly through a distance in the range of about 1 to 20 meters of the ground region.

3. The system according to claim 1, wherein the receivers are configured to receive electromagnetic (EM) data signals from the metallic well structure of the abandoned well severed below the ground region, the EM data signals passing wirelessly via the ground region.

4. The system according to claim 3, wherein the receivers are configured to receive wireless data signals having a frequency in the range of about 0.05 Hz to about 10 Hz.

5. The system according to claim 1, wherein the system is configured to be secured, to the ground region when deployed.

6. The system according to claim 1, wherein the system is configured such that, when deployed, the plurality of receivers are arranged spatially at the ground region in proximity to the abandoned well severed below the ground region, and wherein the spacing between each of the receivers is at regular intervals.

7. The system according to claim 1, wherein the processing unit is configured to process so as to fuse said data signals received using different receivers in order provide a second data signal representative of a least one of said data signals initially communicated to the metallic well structure of the abandoned well.

8. The system according to claim 1, wherein the processing unit is configured to correlate said data signals having been received using different receivers in order provide a second data signal representative of at least one of said data signals initially communicated to the metallic well structure of the abandoned well.

9. The system according to claim 1, wherein the plurality of receivers are configured to receive said data signals using at least two different receiving methods.

10. The system according to claim 9, wherein at least one receiver comprises an electrode and is configured to receive said data signals using a first receiving method while at least one further receiver comprises a loop antenna and is configured to receive said data signals using a second receiving method.

11. The system according to claim 1, wherein the processing unit is further configured to store processed data for subsequent communication, and wherein the processing unit is configured to communicate said processed data from time to time.

12. The system according to claim 1, wherein the system is configured to be deployed in a body of water and is configured to be deployed at a seabed, or a mudline, in proximity to the abandoned well.

13. The system according to claim 12, wherein the system comprises a transmitter configured to communicate processed data wirelessly via the body of water for subsequent receipt at a remote location.

14. The system according to claim 1, further comprising one or more repeater units configured to be positioned at the metallic well structure, and to modulate said data signals being communicated in the metallic well structure for transmission via the ground region.

15. A method for processing data signals from an abandoned well, the method comprising:

using a plurality of receivers and receiving data signals from a metallic well structure of the abandoned well severed below the ground region, the data signals wirelessly transmitted through a ground region from the metallic well structure, the receivers having been deployed in proximity to the abandoned well.

16. The method according to claim 15 comprising monitoring conditions at the abandoned well using data from the received data signals.

17. The method according to claim 15, wherein the method comprises receiving said data signals from the metallic well structure of the abandoned well severed below the ground region, the data signals transmitted wirelessly through a distance in the range of about 1 to 20 meters of ground region.

18. The method according to claim 15, comprising receiving electromagnetic (EM) data signals from the metallic well structure of the abandoned well severed below the ground region, the EM data signals transmitted wirelessly via the ground region, and wherein the data signals have a frequency in the range of about 0.05 Hz to about 10 Hz.

19. The method according to claim 15, comprising receiving said data signals using at least two different receiving methods.

20. A method for monitoring conditions at an abandoned well, comprising:

collecting data associated with an abandoned well, that collected data being derived from data signals having been received from a metallic well structure of the abandoned well severed below the ground region, the data signals transmitted wirelessly via a ground region using a plurality of receivers deployed in proximity to the abandoned well; and monitoring conditions of the abandoned well using the collected data.

* * * * *